US010559263B2

(12) United States Patent
Sun et al.

(10) Patent No.: US 10,559,263 B2
(45) Date of Patent: Feb. 11, 2020

(54) ARRAY SUBSTRATE AND METHOD OF DRIVING THE SAME, DISPLAY APPARATUS

(71) Applicants: BOE Technology Group Co., Ltd., Beijing (CN); Beijing BOE Display Technology Co., Ltd., Beijing (CN)

(72) Inventors: Dongxue Sun, Beijing (CN); Qian Wang, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 15/940,176

(22) Filed: Mar. 29, 2018

(65) Prior Publication Data

US 2019/0130839 A1 May 2, 2019

(30) Foreign Application Priority Data

Oct. 27, 2017 (CN) ..... 2017 1 1038190

(51) Int. Cl.
*G09G 3/36* (2006.01)
*G09G 3/3266* (2016.01)
*G09G 3/3225* (2016.01)

(52) U.S. Cl.
CPC ..... *G09G 3/3266* (2013.01); *G09G 3/3225* (2013.01); *G09G 3/3677* (2013.01);
(Continued)

(58) Field of Classification Search
CPC ..... G09G 3/3208; G09G 3/3611; G09G 2300/0426
(Continued)

(56) References Cited

U.S. PATENT DOCUMENTS 7,453,426 B2 * 11/2008 Yamazaki ..... G09G 3/20 345/1.1
9,858,881 B2 1/2018 Li
(Continued)

FOREIGN PATENT DOCUMENTS

CN 101109856 A 1/2008
CN 102681273 A 9/2012
(Continued)

OTHER PUBLICATIONS

First Office Action, including Search Report, for Chinese Patent Application No. 201711038190.6, dated Feb. 19, 2019, 19 pages.
(Continued)

*Primary Examiner* — Roy P Rabindranath
(74) *Attorney, Agent, or Firm* — Westman, Champlin & Koehler, P.A.

(57) ABSTRACT

An array substrate includes: gate lines; data lines crossing the gate lines; first additional signal lines crossing the gate lines and an array of pixels, pixels in each of rows of pixels are connected to a same one of the gate lines; and there are one data line and one first additional signal line between any two adjacent columns of pixels; the array comprises first rows of pixels and second rows of pixels, the first pixels in each of first rows of pixels are connected respectively to the data lines, and the second pixels in each of second rows of pixels are connected respectively to the first additional signal lines; the gate lines comprise first gate lines and second gate lines, the first rows of pixels are connected respectively to the first gate lines, and the second rows of pixels are connected respectively to the second gate lines.

17 Claims, 11 Drawing Sheets

(52) U.S. Cl.
CPC ..... *G09G 2300/0426* (2013.01); *G09G 2300/0809* (2013.01); *G09G 2310/0205* (2013.01); *G09G 2310/0286* (2013.01); *G09G 2310/08* (2013.01)

(58) Field of Classification Search
USPC ..... 345/76–78
See application file for complete search history.

(56) References Cited

U.S. PATENT DOCUMENTS

| | | | | |
|---|---|---|---|---|
| 10,211,274 | B2 * | 2/2019 | Kim | G09G 3/3275 |
| 10,242,633 | B2 | 3/2019 | Park et al. | |
| 2003/0128180 | A1 * | 7/2003 | Kim | G09G 3/3677 345/100 |
| 2005/0116919 | A1 * | 6/2005 | Shin | G09G 3/325 345/100 |
| 2008/0018572 | A1 | 1/2008 | Shin et al. | |
| 2010/0182297 | A1 | 7/2010 | Lan et al. | |
| 2013/0141658 | A1 | 6/2013 | Lv et al. | |
| 2015/0145904 | A1 * | 5/2015 | Ko | H04N 13/32 345/77 |
| 2016/0225330 | A1 | 8/2016 | Park et al. | |
| 2017/0039972 | A1 * | 2/2017 | Li | G02F 1/136286 |
| 2019/0005905 | A1 | 1/2019 | Chen | |

FOREIGN PATENT DOCUMENTS

| | | | |
|---|---|---|---|
| CN | 102707524 | A | 10/2012 |
| CN | 103208250 | A | 7/2013 |
| CN | 104730791 | A | 6/2015 |
| CN | 105842943 | A | 8/2016 |
| CN | 107068101 | A | 8/2017 |
| EP | 1881365 | A2 | 1/2008 |
| EP | 2597511 | A1 | 5/2013 |
| EP | 3054445 | A2 | 8/2016 |
| EP | 3282312 | A1 | 2/2018 |
| WO | 2013163883 | A1 | 11/2013 |

OTHER PUBLICATIONS

Second Office Action, including Search Report, for Chinese Patent Application No. 201711038190.6, dated Jul. 1, 2019, 13 pages.

* cited by examiner

ARRAY SUBSTRATE AND METHOD OF DRIVING THE SAME, DISPLAY APPARATUS

CROSS-REFERENCE TO RELATED APPLICATION

This application claims priority to Chinese Patent Application No. 201711038190.6 filed on Oct. 27, 2017 in the State Intellectual Property Office of China, the disclosure of which is hereby incorporated by reference in its entirety.

TECHNICAL FIELD

The present disclosure relates to the field of display technology, and particularly to an array substrate and a method of driving the same, and a display apparatus.

BACKGROUND

TFT-LCD (Thin Film Transistor Liquid Crystal Display), or OLED (Organic Light Emitting Diode) display, served as panel display device, is more and more used in the field of high performance display because of its characteristics including small size, low power consumption, no radiation and relatively low cost and the likes.

SUMMARY

According to an aspect of the present disclosure, there is provided an array substrate, the array substrate comprises: a plurality of gate lines extending in a first direction; a plurality of data lines extending in a second direction crossing the first direction; a plurality of first additional signal lines extending in the second direction; and an array of pixels comprising a plurality of pixels arranged in a matrix, the pixels in each of rows of pixels are connected to a same one of the gate lines; and there are one of the data lines and one of the first additional signal lines between any two adjacent columns of pixels; the array of pixels comprises a plurality of first rows of pixels each comprising a plurality of first pixels and a plurality of second rows of pixels each comprising a plurality of second pixels, the first pixels in each of the first rows of pixels are connected respectively to the data lines, and the second pixels in each of the second rows of pixels are connected respectively to the first additional signal lines; the gate lines comprise a plurality of first gate lines and a plurality of second gate lines, the first rows of pixels are connected respectively to the first gate lines, and the second rows of pixels are connected respectively to the second gate lines.

In some embodiments, in any one of columns of pixels, quantity of the first pixels is equal to that of the second pixels.

In some embodiments, the first rows of pixels are located in a first portion of the array substrate, and the second rows of pixels are located in a second portion of the array substrate.

In some embodiments, the first rows of pixels and the second rows of pixels are alternately in the second direction.

In some embodiments, each of the pixels comprises a switching transistor and a pixel electrode; a gate electrode of the switching transistor is connected to one of the gate lines, a first electrode of the switching transistor is connected to one of the data lines or one of the first additional signal lines, and a second electrode of the switching transistor is connected to the pixel electrode.

In some embodiments, each of the pixels comprises a switching transistor, a driving transistor and a light emitting device; a gate electrode of the switching transistor is connected to one of the gate lines, a first electrode of the switching transistor is connected to one of the data lines or one of the first additional signal lines, and a second electrode of the switching transistor is connected to a gate electrode of the driving transistor; a first electrode of the driving transistor is connected to a first operating voltage terminal, a second electrode of the driving transistor is connected to an anode of the light emitting device; and a cathode of the light emitting device is connected to a second operating voltage terminal.

In some embodiments, the plurality of data lines are extended through at least a portion of the array of pixels in the second direction.

In some embodiments, the plurality of first additional signal lines are extended through at least a portion of the array of pixels in the second direction.

In some embodiments, the plurality of data lines and the plurality of first additional signal lines are alternately in the first direction.

In some embodiments, the data lines and the first additional signal lines are in different layers respectively, and an insulation layer is provided between a layer where the data lines is located and a layer where the first additional signal lines is located.

In some embodiments, the data lines and the first additional signal lines are in a same layer.

In some embodiments, the array substrate comprises: a display region in which the array of pixels is provided, and a non-display region surrounding the display region, and a gate drive circuit is provided in the non-display region and comprises a plurality of cascaded shift register units which are connected to the first gate lines respectively and are connected to the second gate lines; wherein, each of the shift register units is connected to one of the first gate lines and one of the second gate lines.

In some embodiments, a source driver is further in the non-display region, and the data lines and the first additional signal lines are connected to different drive channels of the source driver.

In some embodiments, the source driver comprises: a first source driver to which the data lines are connected, and a second source driver to which the first additional signal lines are connected.

In some embodiments, the array substrate further comprising: a plurality of second additional signal lines extending in the second direction, wherein there is one of the second additional signal lines between any two adjacent columns of pixels; the array of pixels further comprises a plurality of third rows of pixels, third pixels in each of the third rows of pixels are connected respectively to the second additional signal lines; and the gate lines further comprise a plurality of third gate lines, the third rows of pixels are connected respectively to the third gate lines.

According to another aspect of the present disclosure, there is provided a display apparatus, the display apparatus comprises the array substrate of the first aspect.

According to yet another aspect of the present disclosure, there is provided a method of driving the array substrate of the first aspect, the method comprises: inputting gate driving signals to one of the first gate lines and one of the second gate lines simultaneously, to turn on one of the first rows of pixels and one of the second rows of pixels simultaneously.

In some embodiments, the method comprises: inputting gate scanning signals to the first gate lines line by line, to turn on the first rows of pixels row by row; and inputting gate scanning signals to the second gate lines line by line, to turn on the second rows of pixels row by row.

In some embodiments, the array substrate further comprises: a plurality of second additional signal lines extending in the second direction, there being one of the second additional signal lines between any two adjacent columns of pixels; a plurality of third rows of pixels, third pixels in each row of the third rows of pixels being connected respectively to the second additional signal lines; and, a plurality of third gate lines being connected respectively to the third gate lines; the method comprises: inputting gate driving signals to one of the first gate lines, one of the second gate lines and one of the third gate lines simultaneously, to turn on one of the first rows of pixels, one of the second rows of pixels and one of the third rows of pixels simultaneously.

BRIEF DESCRIPTION OF THE DRAWINGS

In order to provide a more clear explanation of technical solutions according to embodiments of the present disclosure or in prior art, there is provided a brief introduction of the attached drawings used in the embodiments or in prior art hereinafter. Obviously, the attached drawings mentioned in the following description are merely used to illustrate some embodiments of the present disclosure. Those skilled in the art also could derive other accompanying drawings from these accompanying drawings without making a creative work.

DETAILED DESCRIPTION OF THE EMBODIMENTS

Technique solutions according to embodiments of the present disclosure will be described clearly and completely hereinafter in conjunction with the attached drawings mentioned in embodiments of the present disclosure. Obviously, the embodiments illustrated in these drawings are only some of embodiments of the present disclosure, instead of all of the embodiments of the present disclosure. For those skilled in the art, all other embodiments achieved by referring to the following embodiments of the present disclosure without involving any inventive steps fall into the scope of the present disclosure.

In the following detailed description, terminologies "first", "second", "third" and the likes are only for distinguishing one component from another component, instead of expressing or implying that there is any sequence, quantity or importance among them. Accordingly, features defined with "first", "second", "third" and the likes may express or imply that there includes one or more such features. In the description of embodiments of the present disclosure, unless otherwise specified and defined definitely, "plurality of" indicates two or more.

Figure 1:
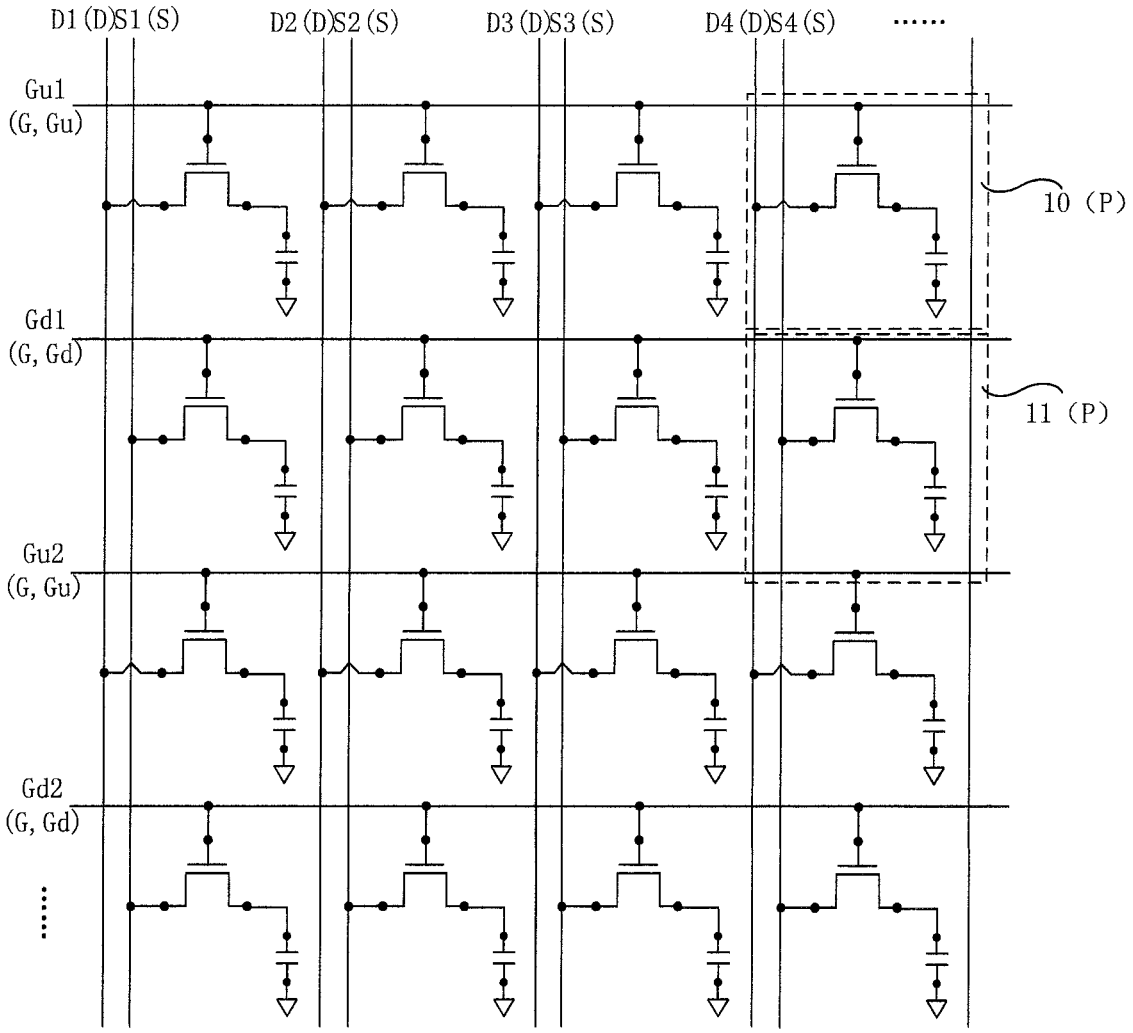
FIG. 1 is a schematic view showing a structure of an array substrate according to an embodiment of the present disclosure.

According to embodiments of the present disclosure, an array substrate is provided. FIG. 1 is a schematic view showing a structure of an array substrate according to an embodiment of the present disclosure. As shown in FIG. 1, an array substrate comprises a plurality of gate lines G (Gu1, Gu2 . . . Gd1, Gd2 . . . ) extending in a first direction and a plurality of data lines D (D1, D2 . . . ) extending in a second direction, and the first direction and the second direction intersect with each other, for example are perpendicular to each other. A plurality of pixels P arranged in a matrix constitutes an array of pixels. One of the gate lines G is provided between any two adjacent rows of pixels, and one of the data lines D is provided between any two adjacent columns of pixels. All the pixels P in each of rows of pixels are connected to a same one of the gate lines G, that is for inputting a gate scanning signal to the pixels P in the rows of pixels connected thereto, to turn on the pixels P.

In addition, at least one additional signal line is provided between any two adjacent columns of pixels. The following description is mainly explained and illustrated by examples in which one single additional signal line (i.e. a first additional signal line S(S1, S2 . . . )) is provided between any two adjacent data lines D. As shown in FIG. 1, the first additional signal lines S(S1, S2 . . . ) are respectively provided between every two adjacent data lines D.

In these embodiments shown in Figures, the array of pixels provided in a display region of the array substrate comprises two groups of rows of pixels, that is, a plurality of first rows of pixels and a plurality of second rows of pixels. Each of the first rows of pixels comprises a plurality of first pixels 10 arranged in the first direction, and each of the second rows of pixels comprises a plurality of second pixels 11 arranged in the first direction. The gate lines G comprises two groups of gate lines, that is, a plurality of first gate lines Gu(Gu1, Gu2 . . . ) and a plurality of second gate lines Gd(Gd1, Gd2 . . . ).

The plurality of first rows of pixels are connected respectively to the plurality of first gate lines Gu(Gu1, Gu2 . . . ), and in each of the first rows of pixels, the plurality of first pixels 10 are connected respectively to the plurality of data lines D(D1, D2 . . . ). The plurality of second rows of pixels are connected respectively to the plurality of second gate lines, and in each of the second rows of pixels, the plurality of second pixels 11 are connected respectively to the plurality of the first additional signal lines S(S1, S2 . . . ). Both the data lines D and the first additional signal lines S are for inputting data signals Data to the pixels P connected respectively thereto (namely the first pixels 10 or the second pixels 11), so that, when the pixels P receive gate scanning signals input from the gate lines G (namely the first gate lines Gu or the second gate lines Gu) and are turned on, the data signals Data are input to pixel circuits of the pixels for charging of the pixels.

The first rows of pixels and the second rows of pixels can be provided alternately. For example, as shown in FIG. 1, the first rows of pixels and the second rows of pixels are provided alternately row by row.

Figure 2:
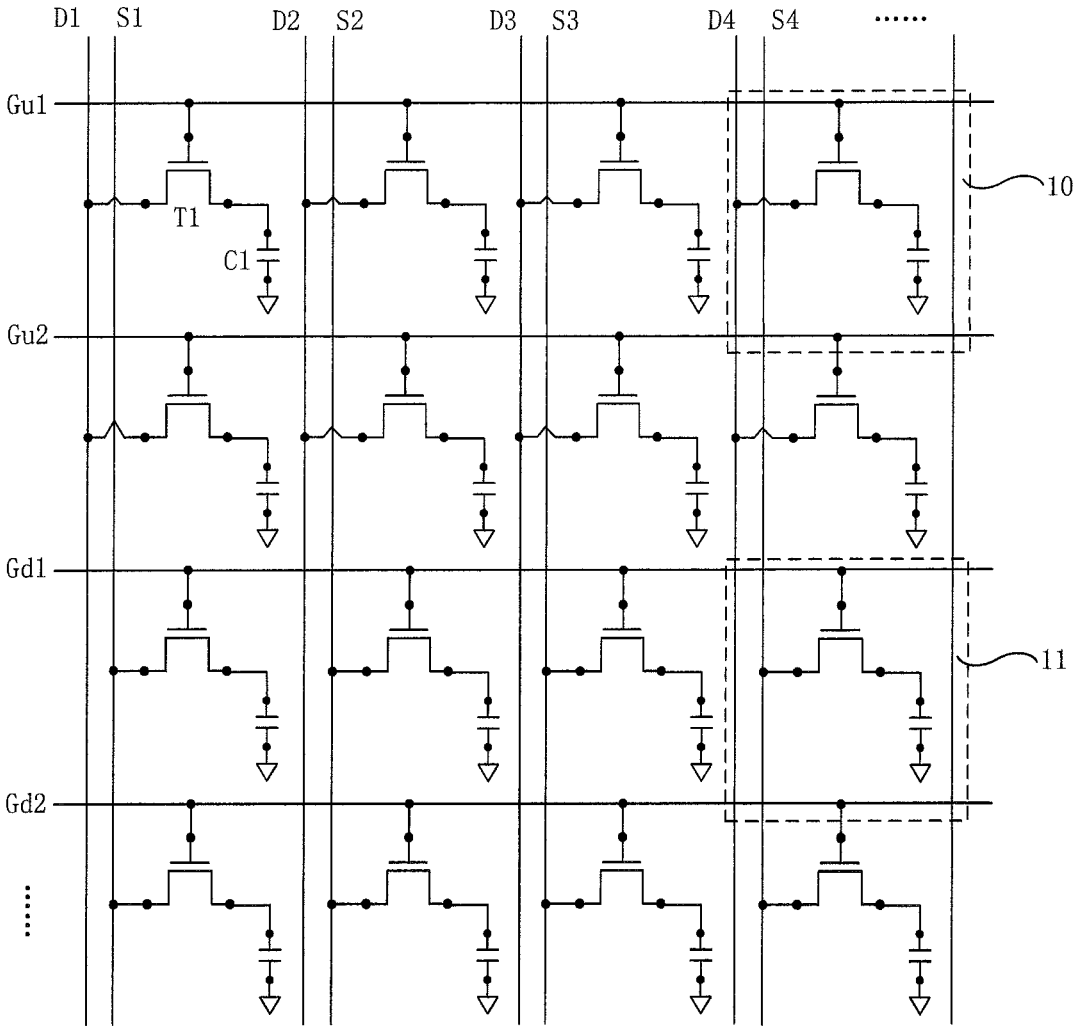
FIG. 2 is a schematic view showing a structure of an array substrate according to another embodiment of the present disclosure.

Alternatively, as shown in FIG. 2, a plurality of (for example two of) first rows of pixels and a plurality of (for example two of) of second rows of pixels are provided alternately.

Figure 3:
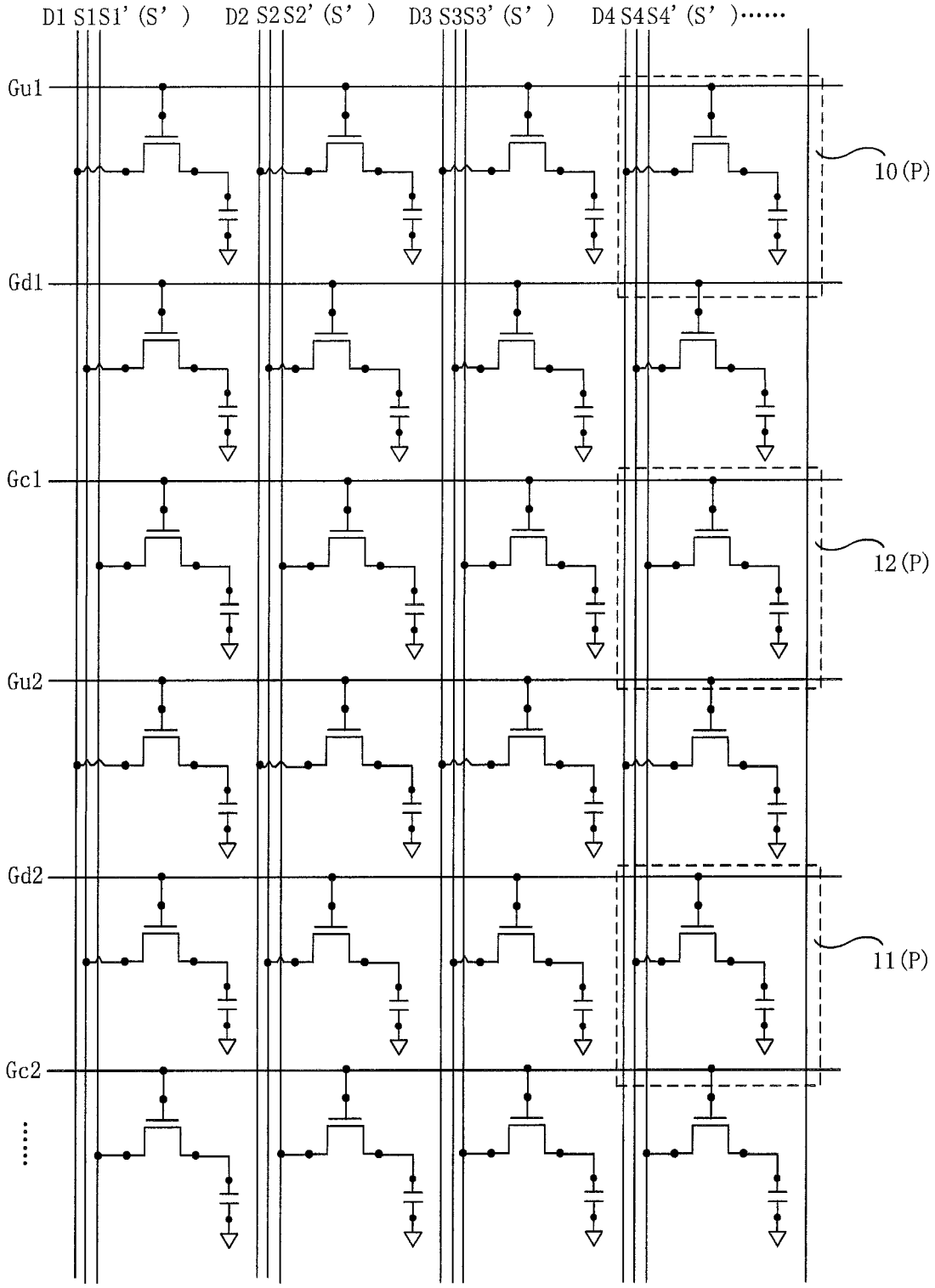
FIG. 3 is a schematic view showing a structure of an array substrate according to yet another embodiment of the present disclosure.

In one embodiment, as shown in FIG. 3, two additional signal lines, namely a first additional signal lines S and a second additional signal lines S', can be between any two adjacent columns of pixels. In this case, on the array substrate, the array of pixels can comprise three groups of rows of pixels, namely, a plurality of first rows of pixels, a plurality of second rows of pixels and a plurality of third rows of pixels. Each of the first rows of pixels comprises a plurality of first pixels 10 arranged in the first direction, each of the second rows of pixels comprises a plurality of second pixels 11 arranged in the first direction, and, each of the third rows of pixels comprises a plurality of third pixels 12 arranged in the first direction. The gate lines G comprises three groups of gate lines, namely, a plurality of first gate lines Gu(Gu1, Gu2 . . . ), a plurality of second gate lines Gd(Gd1, Gd2 . . . ) and a plurality of third gate lines Gc(Gc1, Gc2 . . . ). The first rows of pixels are connected to the first gate lines Gu(Gu1, Gu2 . . . ), respectively, and the first pixels 10 in each of the first rows of pixels are connected to the data lines D(D1, D2 . . . ), respectively. The second rows of pixels are connected to the second gate lines Gd(Gd1, Gd2 . . . ), respectively, and the second pixels 11 in each of the second rows of pixels are connected to the first additional signal lines S(S1, S2 . . . ), respectively. The third rows of pixels are connected to the third gate lines Gc(Gc1, Gc2 . . . ), respectively, and the third pixels 12 in each of the third rows of pixels are connected to the second additional signal lines S'(S'1, S'2 . . . ), respectively.

In some other embodiments, three or more additional signal lines can be provided between any two adjacent columns of pixels.

According to embodiments of the present disclosure, it can be concluded from the above that, at least one additional signal line can be between any two adjacent columns of pixels. The at least one additional signal line for example can include N additional signal line(s), in which N is a positive integer greater than or equal to one, and correspondingly, the array of pixels comprises N+1 groups of rows of pixels, and the gate lines comprises N+1 groups of gate lines.

The above are merely examples of connection manners in which the pixels P located in different rows are respectively connected to different signal lines for outputting of data signals Data, however, in the present disclosure, the connection manner is not limited to this.

It can be concluded from the above that, in the array substrate according to embodiments of the present disclosure, at least two rows of pixels are respectively connected to different signal lines (for example, the data lines D and the first additional signal lines S in the embodiment of FIG. 1) for outputting of data signals Data. In this case, gate scanning signals can be inputted to gate lines G connected to the mentioned at least two rows of pixels simultaneously, to turn on the at least two rows of pixels simultaneously. At the moment, the first pixels 10 in one row of pixels (, for example first row of pixels), that are turned on, receive the data signals Data through the plurality of data lines D, to complete the charging. The second pixels 11 in the other row of pixels (, for example second row of pixels), that are turned on at the same time, receive the data signals Data through the plurality of first additional signal lines S, to complete the charging.

As a result, on one hand, during displaying, data signals can be inputted to at least two rows of pixels simultaneously, so that screen refresh rate of a display apparatus including such an array substrate can be increased on the basis of original one (for example of 60 Hz). For example, in a case where the array of pixels in the array substrate comprises the abovementioned first rows of pixels and second rows of pixels and quantity of the first rows of pixels is the same as that of the second rows of pixels, in the process of scanning the array of pixels, one of the first rows of pixels and one of the second rows of pixels can be scanned simultaneously. In this way, refresh rate of the display apparatus can be doubled. With this configuration, even in the case of high-speed video playback, writing speed of the data signals Data is increased, and screen refresh speed is matched with the increased writing speed of the data signals Data by increasing the refresh rate of the display screen, thereby solving the problem that phenomenon of video ghosting caused by the low refresh rate occurs during displaying.

On the other hand, in a case where data signals Data are inputted to at least two rows of pixels simultaneously, when original refresh rate of for example 60 Hz is kept up, a scanning time for one picture frame is unchanged while several rows of pixels are scanned simultaneously, in this way, compared with a line-by-line scan scheme, quantity of outputting of gate scanning signals by gate driving circuit is reduced. In this case, in order to ensure that the scanning time for one picture frame is unchanged, a charging time of the pixels P in each of rows of pixels is prolonged. For example, the array of pixels in an array substrate comprises the abovementioned first rows of pixels and second rows of pixels and quantity of the first rows of pixels is the same as that of the second rows of pixels, in the process of scanning the array of pixels, one of the first rows of pixels and one of the second rows of pixels can be scanned simultaneously. In this way, since the refresh rate is unchanged, the charging time of the pixels P in each of rows of pixels can be prolonged. Accordingly, it is possible to avoid occurrence of poor displaying, such as horizontal lines, dark areas, etc., caused by insufficient charging time of the pixels P, in a high-resolution display apparatus including large number of pixels.

Figure 4:
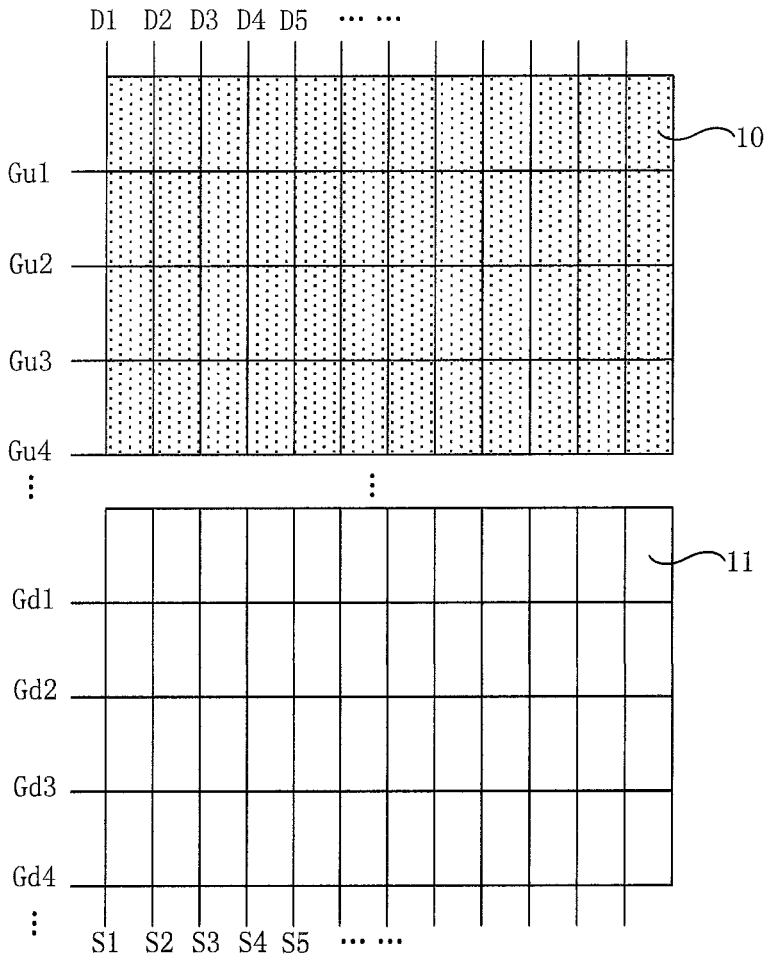
FIG. 4 is a schematic view showing distribution of pixels in an array substrate according to an embodiment of the present disclosure.

In one embodiment, when the array of pixels in an array substrate comprises a plurality of first rows of pixels and a plurality of second rows of pixels, alternatively, as shown in FIG. 4, the plurality of first rows of pixels are all within a first portion (for example an upper portion) of the array substrate, and the plurality of second rows of pixels are all within a second portion (for example a lower portion) of the array substrate. Display region of the array substrate can be dividedly equally into two portions if quantity of the first rows of pixels is the same as that of the second rows of pixels. In this case, during displaying, the first rows of pixels in an upper half portion are scanned row by row, at the same time, the second rows of pixels in a lower half portion are scanned row by row.

Figure 5:
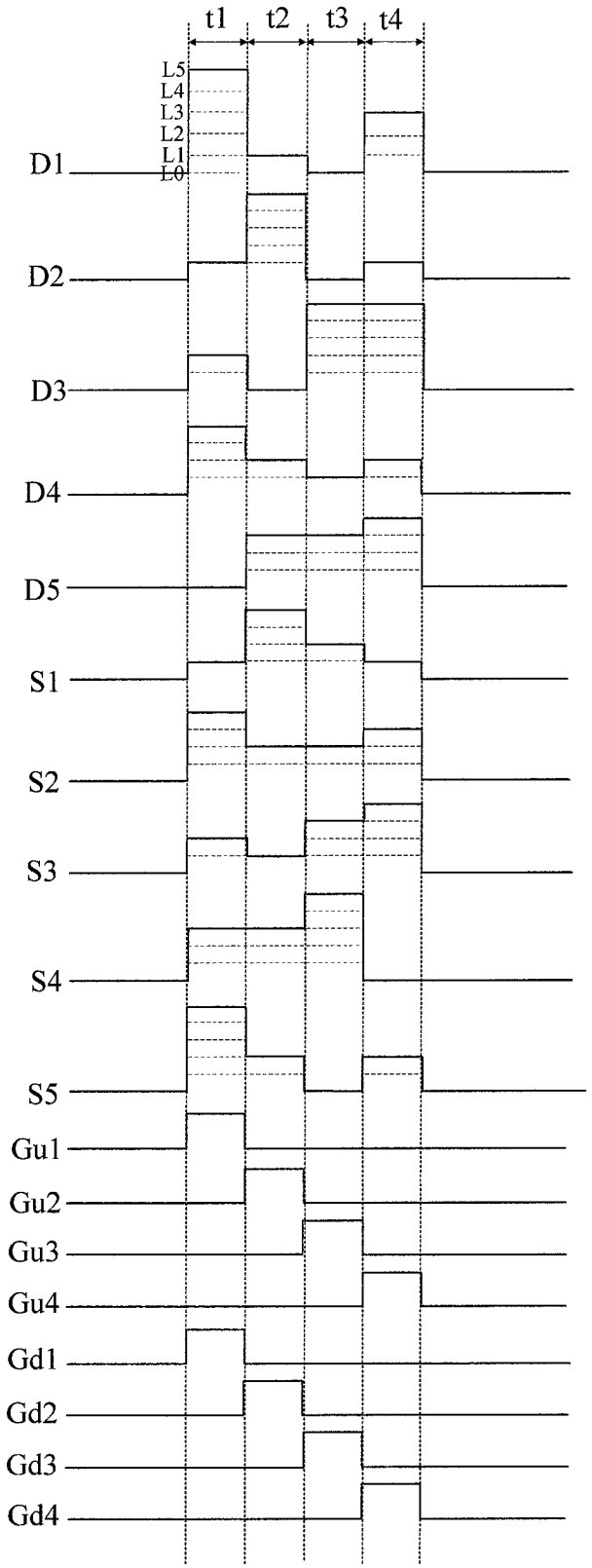
FIG. 5 is a schematic view showing these control signals for driving an array substrate.

Referring to FIG. 5 together with FIG. 4, at the time of t1, a $1^{st}$ first gate line Gu1/ connected to pixels in a $1^{st}$ first row of pixels in the upper half portion and a $1^{st}$ second gate line Gd1 connected to pixels in a $1^{st}$ second row of pixels in the lower half portion receive a gate scanning signal (high level) at the same time, data signals are inputted to the pixels in the $1^{st}$ first row of pixels in the upper half portion through a plurality of data lines D(D1, D2 . . . ), respectively, and data signals are inputted to the pixels in the $1^{st}$ second row of pixels in the lower half portion through a plurality of first additional signal lines S(S1, S2 . . . ), respectively.

At the time of t2, a $2^{nd}$ first gate line Gu2 connected to pixels in a $2^{nd}$ first row of pixels in the upper half portion and a $2^{nd}$ second gate line Gd2 connected to pixels in a $2^{nd}$ second row of pixels in the lower half portion receive a gate scanning signal (high level) at the same time, data signals are inputted to the pixels in the $2^{nd}$ first row of pixels in the upper half portion through a plurality of data lines D(D1, D2 . . . ), respectively, and data signals are inputted to the pixels in the $2^{nd}$ second row of pixels in the lower half portion through a plurality of first additional signal lines S(S1,
S2 . . . ), respectively.

At the time of t3, a $3^{rd}$ first gate line Gu3 connected to pixels in a $3^{rd}$ first row of pixels in the upper half portion and a $3^{rd}$ second gate line Gd3 connected to pixels in a $3^{rd}$ second row of pixels in the lower half portion receive a gate scanning signal (high level) at the same time, data signals are inputted to the pixels in the $3^{rd}$ first row of pixels in the upper half portion through a plurality of data lines D(D1, D2 . . . ), respectively, and data signals are inputted to the pixels in the $3^{rd}$ second row of pixels in the lower half portion through a plurality of first additional signal lines S(S1, S2 . . . ), respectively.

At the time of t4, a $4^{th}$ first gate line Gu4 connected to pixels in a $4^{th}$ first row of pixels in the upper half portion and a $4^{th}$ second gate line Gd4 connected to pixels in a $4^{th}$ second row of pixels in the lower half portion receive a gate scanning signal (high level) at the same time, data signals are inputted to the pixels in the $4^{th}$ first row of pixels in the upper half portion through a plurality of data lines D(D1, D2 . . . ), respectively, and data signals are inputted to the pixels in the $4^{th}$ second row of pixels in the lower half portion through a plurality of first additional signal lines S(S1, S2 . . . ), respectively. Scanning manners of the rest gate lines and manners of inputting data signals to the rest rows of pixels are similar, and it is omitted herein for the sake of brevity.

In addition, in the embodiment as shown in FIG. 4, when display region of the array substrate is divided equally into an upper half portion in which the first rows of pixels are located and a lower half portion in which the second rows of pixels are located, layout of the data lines D and the first additional signal lines S can be the same as that in the embodiment as shown in FIG. 2, that is, a plurality of data lines D connected to the first pixels 10 and plurality of additional signal lines S connected to the second pixels 11 are alternately provided in the first direction, and a length of each of the data lines D and a length of each of the first additional signal lines S can be substantially equal to each other. As a result, the data lines D and the first additional signal lines S have uniform layouts, and thus avoid differences in transmittance between the pixels.

Figure 6:
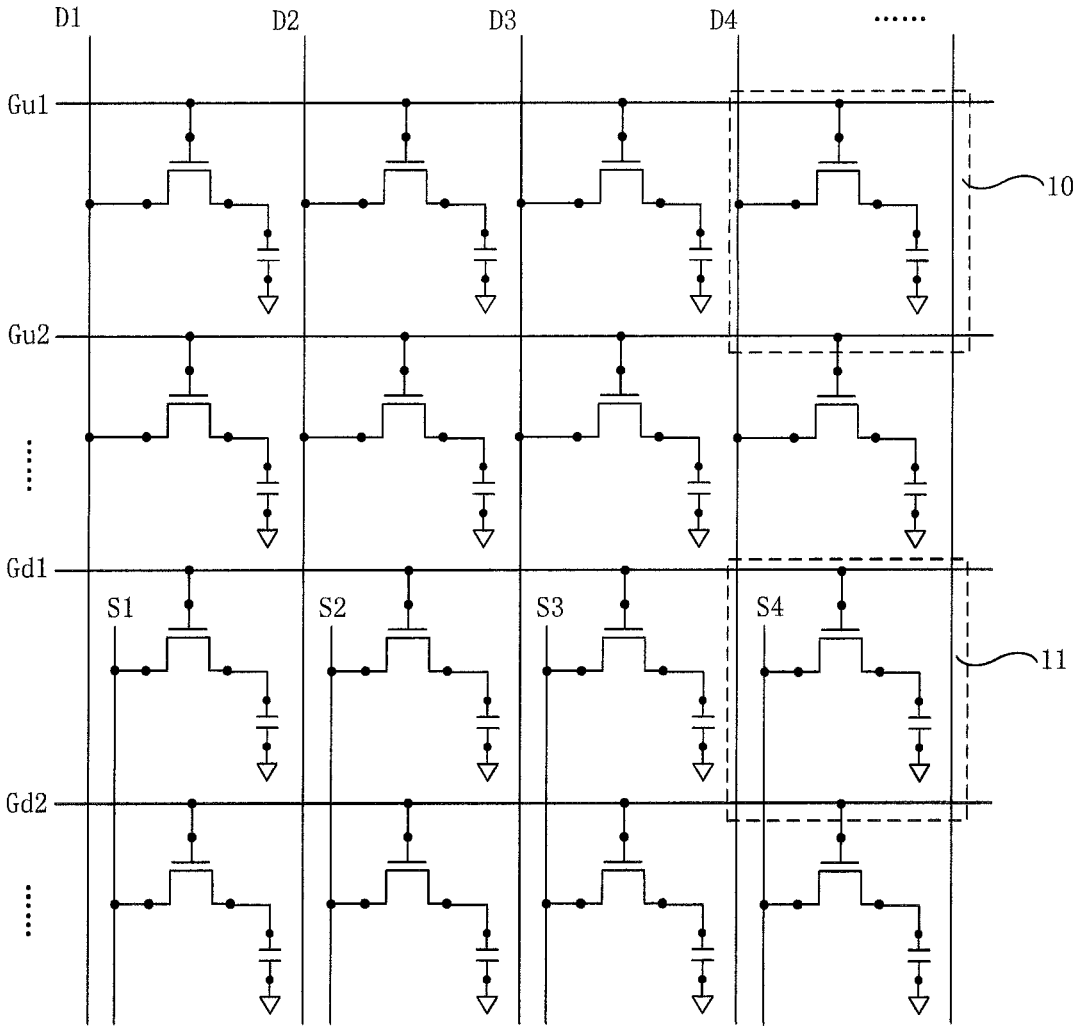
FIG. 6 is a schematic view showing a structure of an array substrate according to an embodiment of the present disclosure, in which pixels connected with data lines are located within an upper half portion of a display region while pixels connected with first additional signal lines are located within a lower half portion of the display region.
Figure 7:
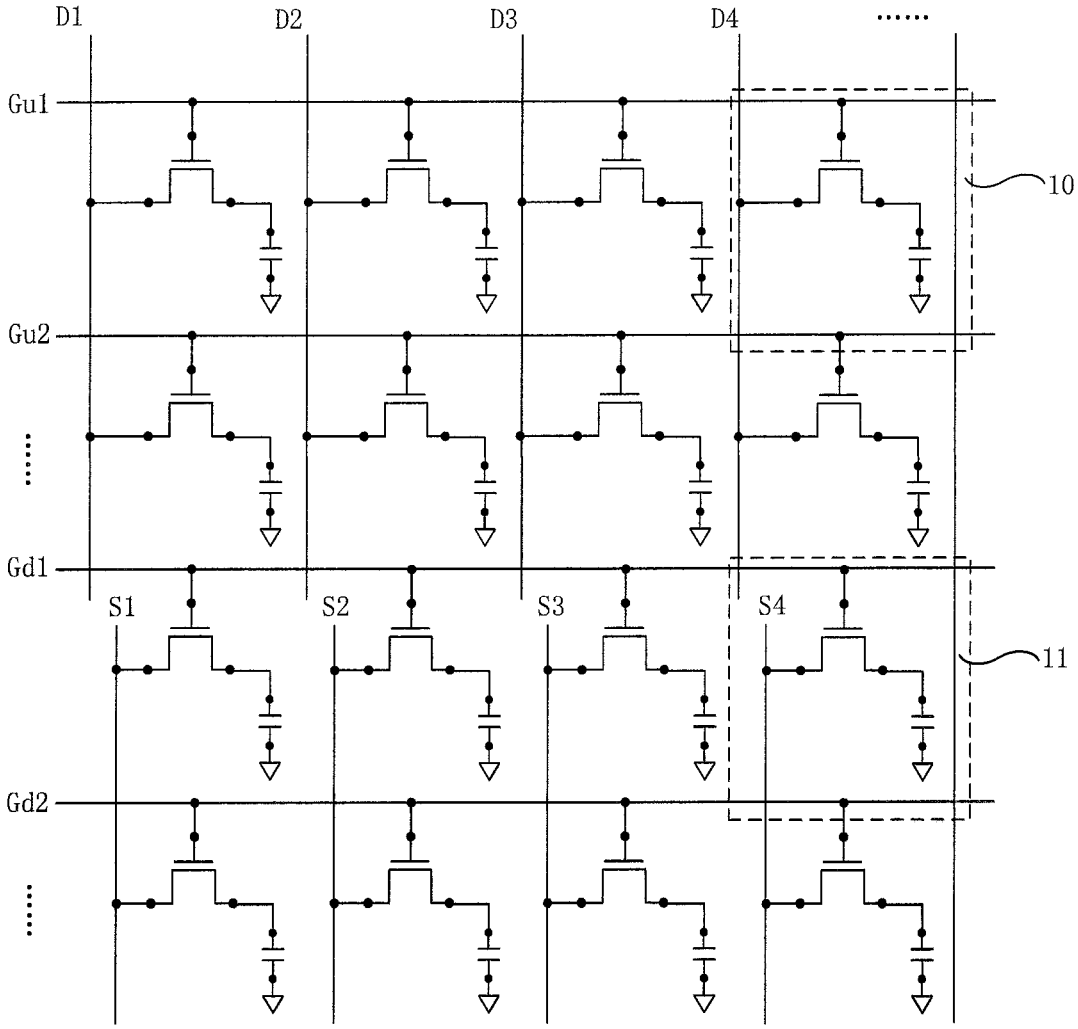
FIG. 7 is a schematic view showing a structure of an array substrate according to another embodiment of the present disclosure, in which pixels connected with data lines are located within an upper half portion of a display region while pixels connected with first additional signal lines are located within a lower half portion of the display region.

In another embodiment, FIG. 6 shows a structure of an array substrate in which pixels connected with data lines are located within an upper half portion of a display region while pixels connected with first additional signal lines are located within a lower half portion of the display region. As shown in FIG. 6, a length of each of the data lines D runs through the display region of the entire array substrate, while the first additional signal lines S are only in the lower half portion of the display region, here, a length of each of the first additional signal lines S is about a half of that of each of the data lines D. In yet another embodiment, FIG. 7 shows another structure of an array substrate in which pixels connected with data lines are located within an upper half portion of a display region while pixels connected with first additional signal lines are located within a lower half portion of the display region. As shown in FIG. 7, the data lines D are only in the upper half portion of the display region, while the first additional signal lines S are only in the lower half portion of the display region, here, a length of each of the first additional signal lines S is substantially equal to that of each of the data lines D. In this case, compared with the embodiment shown in FIG. 2, the data lines D and the first additional signal lines S occupy less area of the display region, and thus the pixels have greater aperture rate.

In should be noted that, herein, orientation terminologies "upper" and "lower" and the likes are explained and illustrated in accordance with placing of the array substrate in Figures. It should be understood that these orientation terminologies, which are relative concepts, are intended for describing and clarifying their relative orientations, which can vary according to change of orientation of placing of the array substrate.

In addition, for a common display screen, the pixels P each usually has a rectangular shape, in this situation, the gate lines G and the data lines D are provided for being perpendicular to and crossing each other. For an abnormal shape display screen, the pixels P each usually has a non-rectangular shape, in this situation, the gate lines G and the data lines D are provided for crossing each other at a certain angle. For easing or simplifying the description, it is taken as an example that the pixels each has a rectangular shape in the following examples and/or embodiments.

In one embodiment, for obtaining a neat layout, the data lines D and the first additional signal lines S are provided for being parallel with each other.

All the data lines D and the first additional signal lines S can be provided in a same layer or in different layers. In a scheme in which the data lines D and the first additional signal lines S are provided in different layers, a space for layout of the data lines D and the first additional signal lines S can be increased. In addition, line width of the data lines D and the first additional signal lines S can be increased suitably, thereby facilitating reduction of line resistance and increase of signal transmission efficiency.

Figure 8:
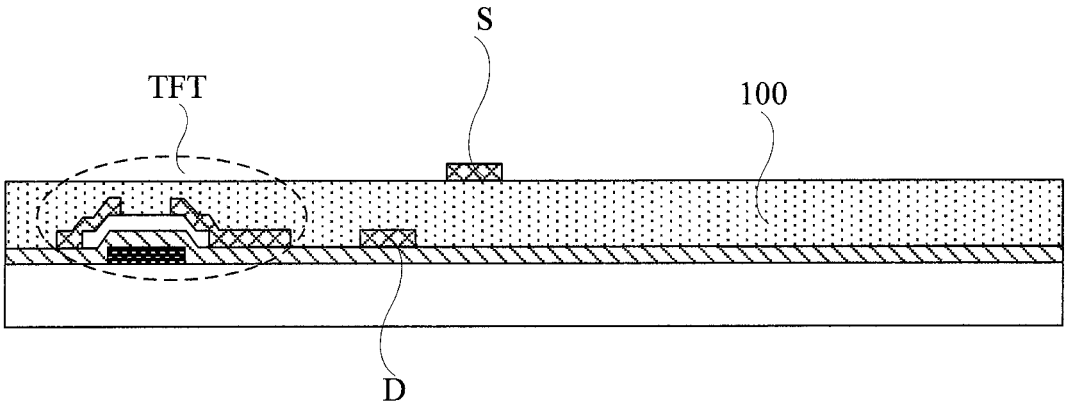
FIG. 8 is a schematic sectional view showing a partial structure of the array substrate in FIG. 1.

FIG. 8 is a schematic sectional view showing a partial structure of the array substrate in FIG. 1. Specifically, in the embodiment of FIG. 8, it is taken as an example that the thin film transistor (TFT) in a pixel is a bottom gate type TFT, and the data lines D are provided in a same layer as a source electrode and a drain electrode of the TFT, while an insulation layer 100 is between the data lines D and the first additional signal lines S.

The array substrate can be applied in a liquid crystal display (LCD) display apparatus, and can also be applied in a light-emitting diode (LED) display apparatus or an organic light-emitting diode (OLED) display apparatus.

Specifically, when the array substrate is applied in a liquid crystal display (LCD) display apparatus, the pixel P in the array substrate, referring to FIG. 2, comprises a switching transistor T1 and a pixel electrode. The pixel electrode is an electrode of a liquid crystal capacity C1 and a common electrode Vcom of the LCD display apparatus is another electrode of a liquid crystal capacity C1.

In this situation, the gate electrode of the switching transistor T1 is connected to the gate line G, a first electrode, for example source electrode, of the switching transistor T1 is connected to a data line D or an first additional signal line S, and a second electrode, for example drain electrode, of the switching transistor T1 is connected to the pixel electrode.

Specifically, the pixels P comprise first pixels 10 and second pixels 11. In the first pixel 10, the gate electrode of the switching transistor T1 is connected to the first gate line Gu, and the first electrode of the switching transistor T1 is connected to the data line D. In the second pixel 11, the gate electrode of the switching transistor T1 is connected to the second gate line Gd, and the first electrode of the switching transistor T1 is connected to the first additional signal line S.

Figure 9:
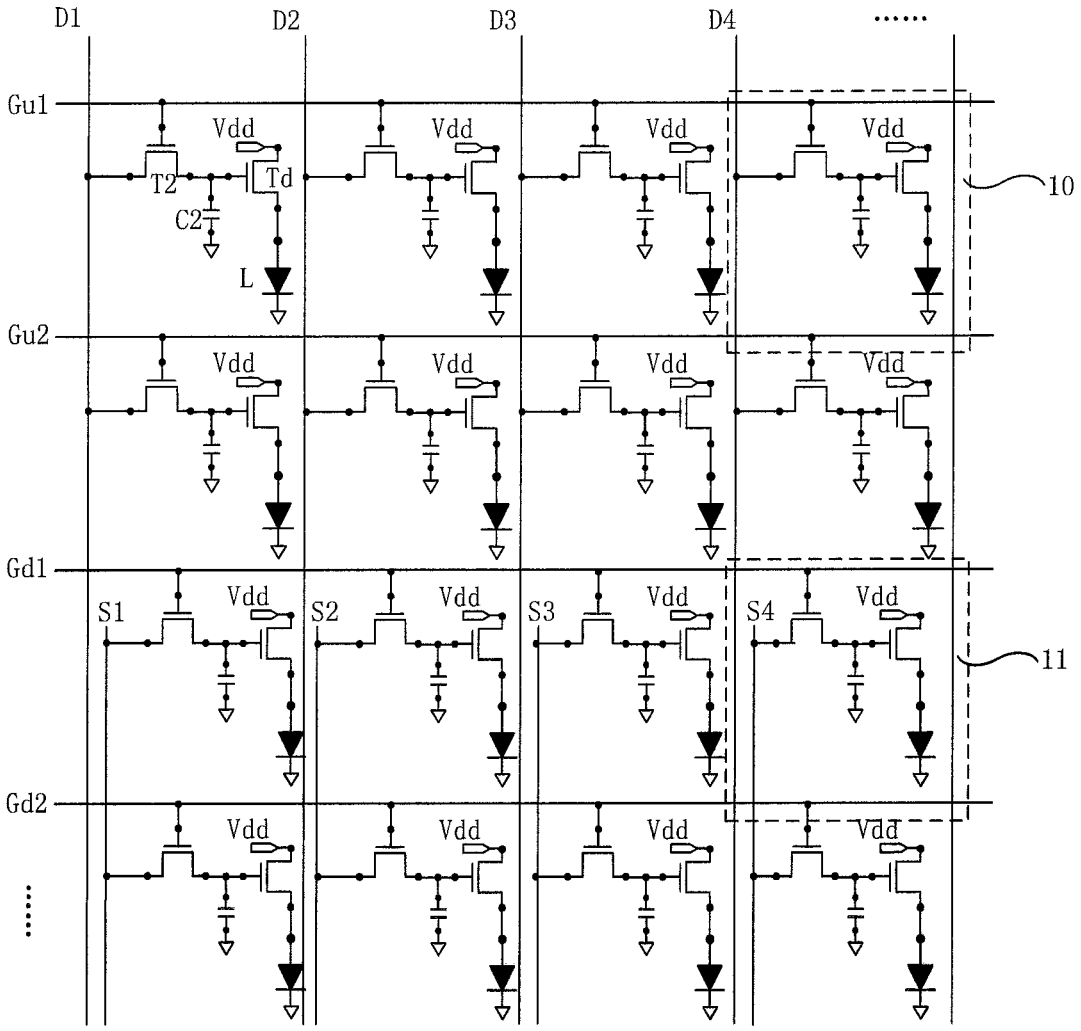
FIG. 9 is a schematic view showing a structure of an array substrate, according to an embodiment of the present disclosure, used in a LED or an OLED display panel.

When the array substrate is applied in a light-emitting diode (LED) display apparatus or an organic light-emitting diode (OLED) display apparatus, the pixel P in the array substrate, referring to FIG. 9, comprises a switching transistor T2, a driving transistor Td and a light emitting device L.

The light emitting device L can be a LED or an OLED. In addition, in order to increase driving capability of the driving transistor Td, the mentioned pixel P can further comprise a storage capacity C2.

In this situation, the gate electrode of the switching transistor T2 is connected to the gate line G, a first electrode, for example source electrode, of the switching transistor T2 is connected to a data line D or an first additional signal line S, and a second electrode, for example drain electrode, of the switching transistor T2 is connected to gate electrode of the driving transistor Td.

Specifically, the pixels P comprise first pixels 10 and second pixels 11. In the first pixel 10, the gate electrode of the switching transistor T2 is connected to the first gate line Gu, and the first electrode of the switching transistor T2 is connected to the data line D. In the second pixel 11, the gate electrode of the switching transistor T2 is connected to the second gate line Gd, and the first electrode of the switching transistor T2 is connected to the first additional signal line S.

In addition, the first electrode of the switching transistor Td is connected to a first operating voltage terminal Vdd, the second electrode of the switching transistor Td is connected to an anode of the light emitting device L, and a cathode of the light emitting device L is connected to a second operating voltage terminal (grounded terminal or Vss).

Of course, when pixel circuit of an OLED display apparatus further owns a reset function and a threshold voltage compensating function, the pixel circuit further comprises other transistors for achieving the above functions. There is no specific limitation on the pixel circuit in the present disclosure, as long as it is ensured that it comprises at least the abovementioned switching transistor T2, the driving transistor Td, and the storage capacity C2.

According to another aspect, a display apparatus according to embodiments of the present disclosure comprises any one of the abovementioned array substrate. Since the display apparatus has a same technical effect as the array substrate according to the mentioned embodiments of the present disclosure, the description is omitted for the sake of brevity.

It should be noted that, according to embodiments of the present disclosure, the display apparatus can comprise at least a LCD display apparatus or a LED display apparatus or an OLED display apparatus. In addition, the display apparatus can be any products or components having a display function, including a display, a TV, a digital photo frame, a mobile phone or a tablet computer, and the like.

Figure 10:
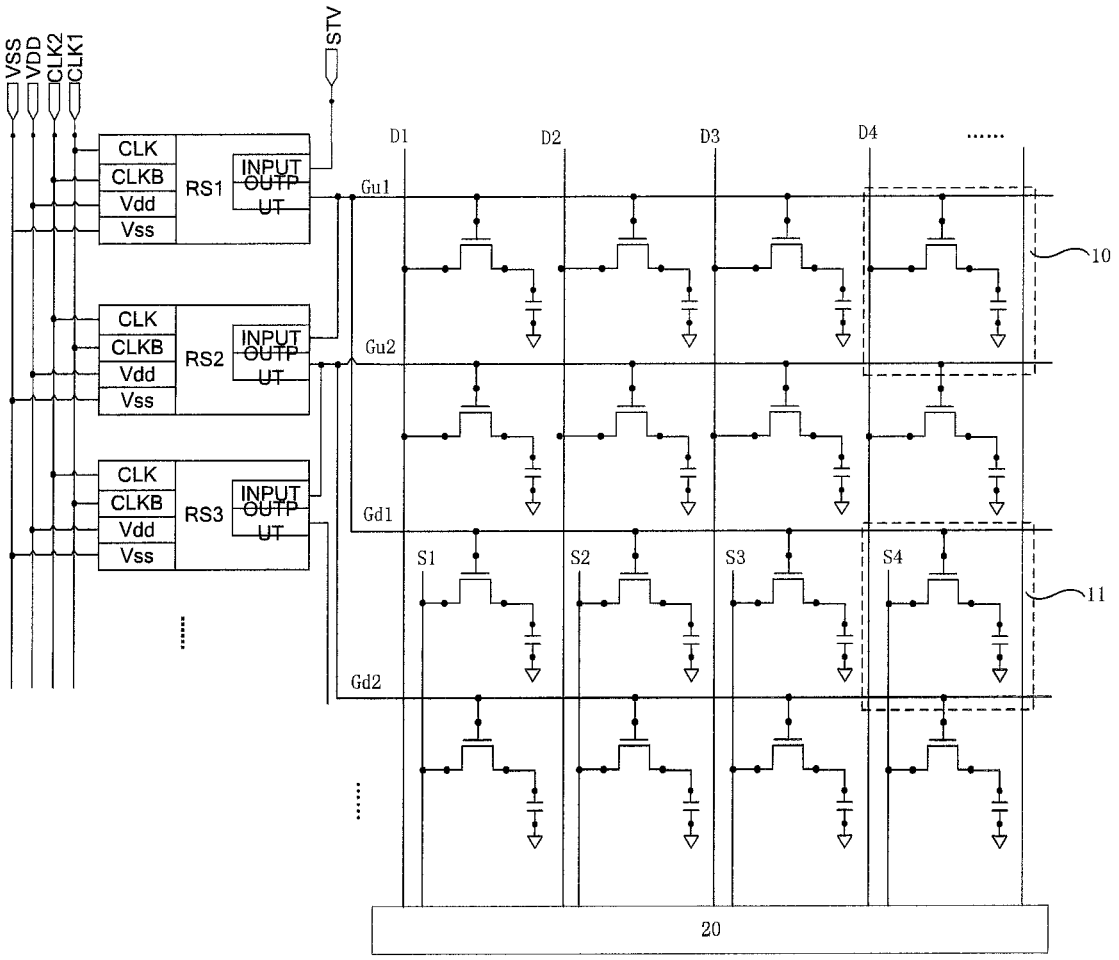
FIG. 10 is a schematic view showing a structure of an array substrate, according to an embodiment of the present disclosure, including a drive circuit.

In one embodiment, the array substrate further comprises: a display region and a non-display region around the display region. Gate driving circuit, as shown in FIG. 10, including a plurality of cascaded shift register units RS(RS1, RS2, RS3 . . . ) is provided in the non-display region.

It is taken as an example that the gate lines comprise a plurality of first gate lines Gu(Gu1,Gu2 . . . ) and a plurality of second gate lines Gd(Gd1,Gd2 . . . ).

The plurality of cascaded shift register units RS are connected respectively to the plurality of first gate lines Gu, the plurality of cascaded shift register units RS are connected respectively to the plurality of second gate lines Gd, and each of the shift register units RS is connected to one of the first gate lines Gu and one of the second gate lines Gd.

Specifically, a first shift register unit RS1 is connected to a $1^{st}$ first gate line Gu1 in the upper half portion and a $1^{st}$ second gate line Gd1 in the lower half portion. In the situation, the first shift register unit RS1 can output a gate scanning signal to the $1^{st}$ first gate line Gu1 and the $1^{st}$ second gate line Gd1 at the same time, to drive a $1^{st}$ first row of pixels and a $1^{st}$ second row of pixels simultaneously.

A second shift register unit RS2 is connected to a $2^{nd}$ first gate line Gu2 in the upper half portion and a $2^{nd}$ second gate line Gd2 in the lower half portion. In the situation, the second shift register unit RS2 can output a gate scanning signal to the $2^{nd}$ first gate line Gu2 and the $2^{nd}$ second gate line Gd2 at the same time, to drive a $2^{nd}$ first row of pixels and a $2^{nd}$ second row of pixels simultaneously.

A third shift register unit RS3 is connected to a $3^{rd}$ first gate line Gu3 in the upper half portion and a $3^{rd}$ second gate line Gd3 in the lower half portion. In the situation, the third shift register unit RS3 can output a gate scanning signal to the $3^{rd}$ first gate line Gu3 and the $3^{rd}$ second gate line Gd3 at the same time, to drive a $3^{rd}$ first row of pixels and a $3^{rd}$ second row of pixels simultaneously.

Manner of the connections between the rest shift register units and the rest gate lines, as well as manner of driving the rest pixels, are similar, and it is omitted herein for the sake of brevity.

In addition, at least one source driver is further in the non-display region of the abovementioned array substrate. For example, as shown in FIG. 10, one source driver 20 is further in the non-display region of the array substrate, and the data lines D and the first additional signal lines S are connected to different drive channels of the source driver 20.

Figure 11:
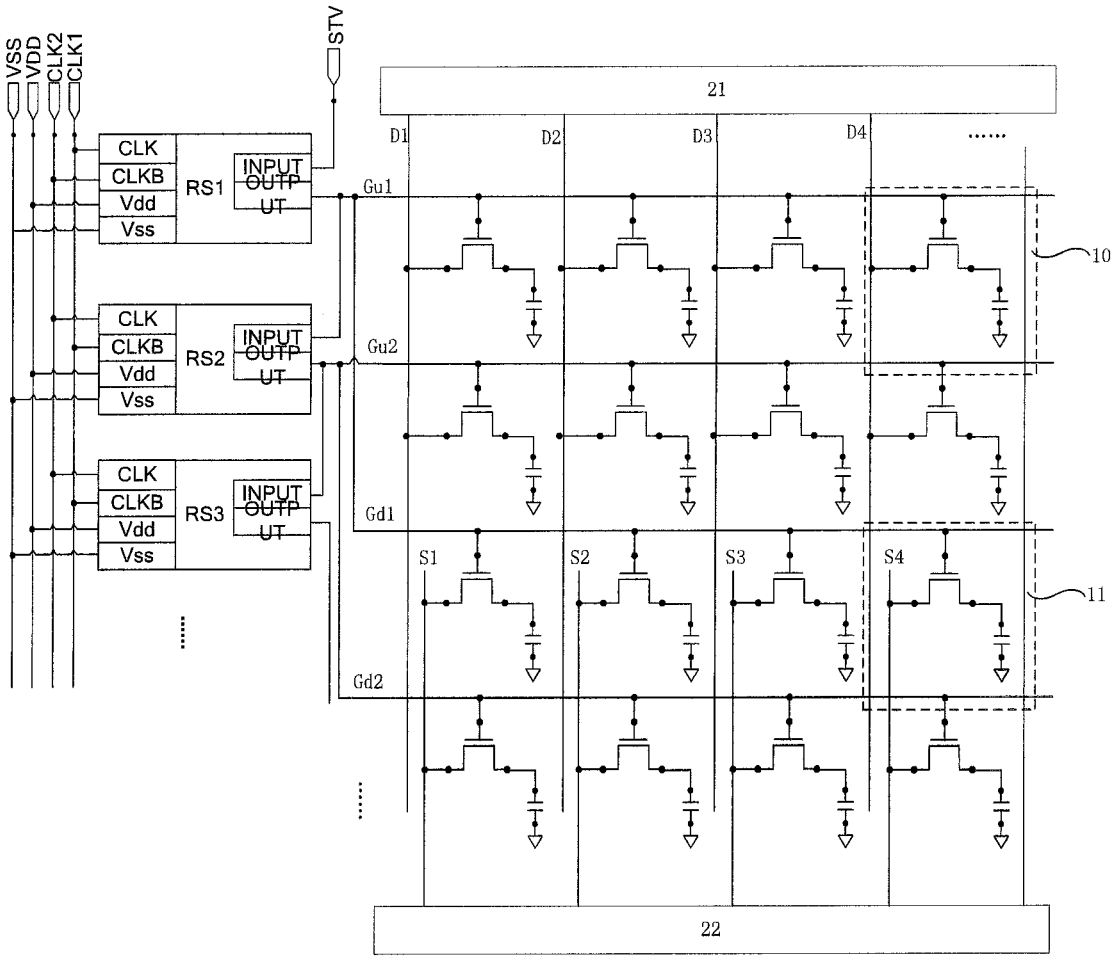
FIG. 11 is a schematic view showing a structure of an array substrate, according to another embodiment of the present disclosure, including a drive circuit.

Two source drivers are further in the non-display region. For example, as shown in FIG. 11, two source drivers 20, namely a first source driver 21 and a second source driver 22, are further in the non-display region, and the data lines D and the first additional signal lines S are connected to different source drivers. For example, the data lines D are connected to the first source driver 21, and the first additional signal lines S are connected to second source driver 22. As a result, it can be ensured that, both the data lines D and the first additional signal lines S can output data signals Data at the same time.

In one embodiment, there is provided a method of driving any one of the abovementioned array substrates. The method comprises:

inputting gate driving signals to at least two gate lines G simultaneously, to turn on at least two rows of pixels simultaneously through the data lines D and the first additional signal lines respectively.

The driving method according to embodiments of the present disclosure is explained and illustrated by taking an array substrate in which one additional signal line (namely, the first additional signal line S) is between any two adjacent data lines D as an example, and is based on the array substrate of FIG. 6 and layout of the pixels shown in FIG. 4.

As shown in FIG. 6, the array of pixels, provided in the display region of the array substrate, comprises a plurality of first rows of pixels and a plurality of second rows of pixels. Each of the first rows of pixels comprises a plurality of first pixels 10 arranged in the first direction, and each of the second rows of pixels comprises a plurality of second pixels 11 arranged in the first direction. The gate lines G comprise a plurality of first gate lines Gu(Gu1, Gu2 . . . ) and a plurality of second gate lines Gd(Gd1, Gd2 . . . ).

The plurality of first rows of pixels are connected respectively to the plurality of first gate lines Gu(Gu1, Gu2 . . . ), and in each of the first rows of pixels, the plurality of first pixels 10 are connected respectively to the plurality of data lines D(D1, D2 . . . ). The plurality of second rows of pixels are connected respectively to the plurality of second gate lines, and in each of the second rows of pixels, the plurality of second pixels 11 are connected respectively to the plurality of first additional signal lines S(S1, S2 . . . ).

The driving method specifically comprises: inputting gate driving signals to one of the first gate lines Gu and one of the second gate lines Gd simultaneously, to turn on one of the first rows of pixels and one of the second rows of pixels simultaneously, so that the plurality of first pixels 10 in the turned-on one of the first rows of pixels are charged through the plurality of data lines D, respectively, namely, data signals are input, at the same time, the plurality of second pixels 11 in the turned-on one of the second rows of pixels are charged through the plurality of first additional signal lines S, respectively, namely, data signals are input.

The driving method further comprises:

inputting gate scanning signals to the first gate lines Gu(Gu1, Gu2 . . . ) line by line, to turn on the first rows of pixels row by row; and at the same time, inputting gate scanning signals to the second gate lines Gd(Gd1, Gd2 . . . ) line by line, to turn on the second rows of pixels row by row.

When the array substrate adopts the layout of pixels as shown in FIG. 4, that is, display region of the array substrate can be divided equally into an upper half portion where a plurality of first rows of pixels is located and a lower half portion where a plurality of second rows of pixels is located, specifically, drive controlling signals scan $1^{st}$ first gate line Gu1, $2^{nd}$ first gate line Gu2, $3^{rd}$ first gate line Gu3 . . . line by line, and at the same time, scan $1^{st}$ second gate line Gd1, $2^{nd}$ second gate line Gd2, $3^{rd}$ second gate line Gd3 . . . line by line.

In this situation, a gate scanning signal (high level) is input to a $1^{st}$ first gate line Gu1 in the upper half portion, and at the same time, the gate scanning signal (high level) is input to a $1^{st}$ second gate line Gu1 in the lower half portion. Another gate scanning signal (high level) is input to a $2^{nd}$ first gate line Gu2 in the upper half portion, and at the same time, the gate scanning signal (high level) is input to a $2^{nd}$ second gate line Gu2 in the lower half portion. Another gate scanning signal (high level) is input to a $3^{rd}$ first gate line Gu3 in the upper half portion, and at the same time, the gate scanning signal (high level) is input to a $3^{rd}$ second gate line Gu3 in the lower half portion. Scanning manners of the rest gate lines are similar, and it is omitted herein for the sake of brevity.

Figure 12:
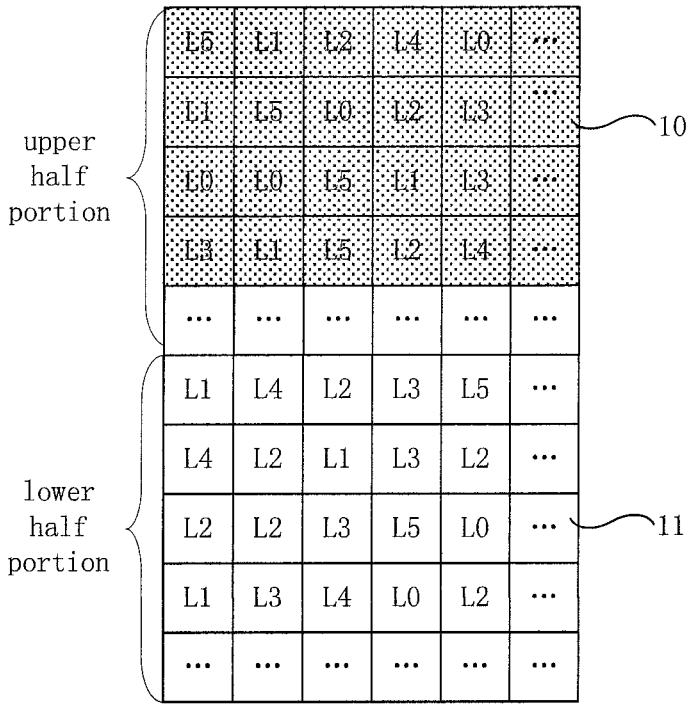
FIG. 12 is a schematic view showing a resulted charging state of pixels in an array substrate according to an embodiment of the present disclosure.

In addition, the turned-on first rows of pixels in the upper half portion of the display region are charged through the data lines D, and at the same time, the turned-on second rows of pixels in the lower half portion of the display region are charged through the first additional signal lines S. FIG. 12 is a schematic view showing a resulted charging state of pixels in an array substrate having a layout of pixels shown in FIG. 4 while the pixels are driven by drive controlling signals as shown in FIG. 5, and in this figure only four rows and five column pixels are presented schematically in each of the upper half portion and the lower half portion.

Specifically, as shown in FIG. 5, at the time of t1, when a $1^{st}$ first gate line Gu1 in the upper half portion and a $1^{st}$ second gate line Gd1 in the lower half portion receive a gate scanning signals, $1^{st}$ first row of pixels in the upper half portion are turned on, and at the same time, $1^{st}$ second row of pixels in the lower half portion are turned on.

Here, at the time of t1, data signals Data L5, L1, L2, L4, L0, as shown in FIG. 5, are input respectively to the plurality of first pixels 10 of the turned-on $1^{st}$ first row of pixels in the upper half portion through the data lines D1, D2, D3, D4, D5. At the moment, the plurality of first pixels 10 of the turned-on $1^{st}$ first row of pixels in the upper half portion receive the mentioned data lines (L5, L1, L2, L4, L0), respectively, as shown in FIG. 12. At the same time, data signals Data L1, L4, L2, L3, L5, as shown in FIG. 5, are input respectively to the plurality of second pixels 11 of the turned-on $1^{st}$ second row of pixels in the lower half portion through the first additional signal lines S1, S2, S3, S4, S5. At the moment, the plurality of second pixels 11 of the turned-on $1^{st}$ second row of pixels in the lower half portion receive the mentioned data lines (L1, L4, L2, L3, L5), respectively, as shown in FIG. 12.

In like manner, at the time of t2, another gate scanning signal is output through a $2^{nd}$ first gate lines Gu2 in the upper half portion and a $2^{nd}$ second gate lines Gd2 in the lower half portion simultaneously. Here, at the time of t2, data signals Data L1, L5, L0, L2, L3, as shown in FIG. 5, are input respectively to the plurality of first pixels 10 of the turned-on $2^{nd}$ first row of pixels in the upper half portion through the data lines D1, D2, D3, D4, D5. At the moment, the plurality of first pixels 10 of the turned-on $2^{nd}$ first row of pixels in the upper half portion receive the mentioned data lines (L1, L5, L0, L2, L3), respectively, as shown in FIG. 12. At the same time, data signals Data L4, L2, L1, L3, L2, as shown in FIG. 5, are input respectively to the plurality of second pixels 11 of the turned-on $2^{nd}$ second row of pixels in the lower half portion through the first additional signal lines S1, S2, S3, S4, S5. At the moment, the plurality of second pixels 11 of the turned-on $2^{nd}$ second row of pixels in the lower half portion receive the mentioned data lines (L4, L2, L1, L3, L2), respectively, as shown in FIG. 12.

Scanning manners of the rest gate lines and manners of charging the rest pixels P are similar, and it is omitted herein for the sake of brevity.

Also, a method of driving the array substrate in the embodiment of FIG. 3 is similar to that in the abovementioned embodiment. The driving method comprises: inputting gate driving signals to one of the first gate lines Gu, one of the second gate lines Gd and one of the third gate lines Gc simultaneously, to turn on one of the first rows of pixels, one of the second rows of pixels and one of the third rows of pixels simultaneously. The first pixels 10 in the turned-on one of the first rows of pixels are charged through the data lines D, respectively, and at the same time, the second pixels 11 in the turned-on one of the second rows of pixels are charged through the first additional signal lines S, respectively, and at the same time, the third pixels 12 in the turned-on one of the third rows of pixels are charged through the second additional signal lines S', respectively.

The driving method comprises: inputting gate scanning signals to the first gate lines Gu line by line, to turn on the first rows of pixels row by row;

and at the same time, inputting gate scanning signals to the second gate lines Gd line by line, to turn on the second rows of pixels row by row; and and at the same time, inputting gate scanning signals to the second gate Gc lines line by line, to turn on the third rows of pixels row by row.

Three or more additional signal lines can be provided between any two adjacent columns of pixels.

According to embodiments of the present disclosure, at least one additional signal line can be provided between any two adjacent columns of pixels. The at least one additional signal line for example can include N additional signal line(s), in which N is a positive integer greater than or equal to one, and correspondingly, the array of pixels comprises N+1 groups of rows of pixels, and the gate lines comprises N+1 groups of gate lines. The driving method for this is similar to these in the above. One gate line in each of the N+1 groups of gate lines is driven simultaneously, and in each of the N+1 groups of gate lines, gate scanning signals are input line by line sequentially through the gate lines.

The above are only specific embodiments of the present disclosure, and the scope of the present disclosure will in no way be limited to the above. It will be apparent for those skilled in the art that various changes and modifications made easily in these embodiments without departing from the principles and spirit of the present disclosure should fall into the scope of the claims and their equivalents of the present disclosure. Therefore, the scope of the present disclosure is defined in the claims and their equivalents.

What is claimed is:

1. An array substrate, comprising:

a plurality of gate lines extending in a first direction;

a plurality of data lines extending in a second direction crossing the first direction;

a plurality of first additional signal lines extending in the second direction; and an array of pixels comprising a plurality of pixels arranged in a matrix, wherein, the pixels in each of rows of pixels are connected to a same one of the gate lines; and there are one of the data lines and one of the first additional signal lines between any two adjacent columns of pixels;

the array of pixels comprises a plurality of first rows of pixels each comprising a plurality of first pixels and a plurality of second rows of pixels each comprising a plurality of second pixels, the first pixels in each of the first rows of pixels are connected respectively to the data lines, and the second pixels in each of the second rows of pixels are connected respectively to the first additional signal lines;

the gate lines comprise a plurality of first gate lines and a plurality of second gate lines, the first rows of pixels are connected respectively to the first gate lines, and the second rows of pixels are connected respectively to the second gate lines, the first rows of pixels are located in a first portion of the array substrate, and the second rows of pixels are located in a second portion of the array substrate, each of the first portion and the second portion is continuous, and the first portion and the second portion are adjacent to each other in the second direction.

2. The array substrate of claim 1, wherein, in any one of columns of pixels, quantity of the first pixels is equal to that of the second pixels.

3. The array substrate of claim 1, wherein, each of the pixels comprises a switching transistor and a pixel electrode;

a gate electrode of the switching transistor is connected to one of the gate lines, a first electrode of the switching transistor is connected to one of the data lines or one of the first additional signal lines, and a second electrode of the switching transistor is connected to the pixel electrode.

4. The array substrate of claim 1, wherein, each of the pixels comprises a switching transistor, a driving transistor and a light emitting device;

a gate electrode of the switching transistor is connected to one of the gate lines, a first electrode of the switching transistor is connected to one of the data lines or one of the first additional signal lines, and a second electrode of the switching transistor is connected to a gate electrode of the driving transistor;

a first electrode of the driving transistor is connected to a first operating voltage terminal, a second electrode of the driving transistor is connected to an anode of the light emitting device; and a cathode of the light emitting device is connected to a second operating voltage terminal.

5. The array substrate of claim 1, wherein, the plurality of data lines are extended through at least a portion of the array of pixels in the second direction.

6. The array substrate of claim 1, wherein, the plurality of first additional signal lines are extended through at least a portion of the array of pixels in the second direction.

7. The array substrate of claim 1, wherein, the plurality of data lines and the plurality of first additional signal lines are alternately in the first direction.

8. The array substrate of claim 1, wherein, the data lines and the first additional signal lines are in different layers respectively, and an insulation layer is provided between a layer where the data lines is located and a layer where the first additional signal lines is located.

9. The array substrate of claim 1, wherein, the data lines and the first additional signal lines are in a same layer.

10. The array substrate of claim 1, wherein, the array substrate comprises: a display region in which the array of pixels is provided, and a non-display region surrounding the display region, and a gate drive circuit is provided in the non-display region and comprises a plurality of cascaded shift register units which are connected to the first gate lines respectively and are connected to the second gate lines; wherein, each of the shift register units is connected to one of the first gate lines and one of the second gate lines.

11. The array substrate of claim 10, wherein, a source driver is further in the non-display region, and the data lines and the first additional signal lines are connected to different drive channels of the source driver.

12. The array substrate of claim 11, wherein, the source driver comprises: a first source driver to which the data lines are connected, and a second source driver to which the first additional signal lines are connected.

13. The array substrate of claim 1, further comprising:

a plurality of second additional signal lines extending in the second direction, wherein there is one of the second additional signal lines between any two adjacent columns of pixels;

the array of pixels further comprises a plurality of third rows of pixels, third pixels in each of the third rows of pixels are connected respectively to the second additional signal lines; and the gate lines further comprise a plurality of third gate lines, the third rows of pixels are connected respectively to the third gate lines.

14. A display apparatus, comprising the array substrate of claim 1.

15. A method of driving the array substrate of claim 1, the method comprising:

inputting gate driving signals to one of the first gate lines and one of the second gate lines simultaneously, to turn on one of the first rows of pixels and one of the second rows of pixels simultaneously.

16. The method of claim 15, comprising:

inputting gate scanning signals to the first gate lines line by line, to turn on the first rows of pixels row by row; and inputting gate scanning signals to the second gate lines line by line, to turn on the second rows of pixels row by row.

17. A method of driving the array substrate of claim 1, wherein the array substrate further comprises: a plurality of second additional signal lines extending in the second direction, there being one of the second additional signal lines between any two adjacent columns of pixels; a plurality of third rows of pixels, third pixels in each row of the third rows of pixels being connected respectively to the second additional signal lines; and, a plurality of third gate lines being connected respectively to the third gate lines;

the method comprising:

inputting gate driving signals to one of the first gate lines, one of the second gate lines and one of the third gate lines simultaneously, to turn on one of the first rows of pixels, one of the second rows of pixels and one of the third rows of pixels simultaneously.

* * * * *